United States Patent [19]

Schwarze

[11] 4,236,398

[45] Dec. 2, 1980

[54] TUBE BENDING MACHINE

[76] Inventor: Rigobert Schwarze, Olpener Str. 460-474, 5000 Cologne 91, Fed. Rep. of Germany

[21] Appl. No.: 951,293

[22] Filed: Oct. 13, 1978

[30] Foreign Application Priority Data

Oct. 18, 1977 [DE] Fed. Rep. of Germany ..... 2746721

[51] Int. Cl.[3] ..... B21D 7/04

[52] U.S. Cl. ..... 72/157

[58] Field of Search ..... 72/149, 150, 154, 155, 72/157, 158, 159, 477, 478

[56] References Cited

U.S. PATENT DOCUMENTS

| | | | |
|---|---|---|---|
| 1,831,777 | 11/1931 | Nunamaker | 72/157 |
| 3,147,792 | 9/1964 | Hautau | 72/157 |
| 3,151,656 | 10/1964 | Brede | 72/157 |
| 3,299,681 | 1/1967 | Hautau | 72/7 |
| 4,038,853 | 8/1977 | Schwarze | 72/157 |
| 4,137,743 | 2/1979 | Schwarze | 72/150 |

FOREIGN PATENT DOCUMENTS

| | | | |
|---|---|---|---|
| 627701 | 11/1961 | Italy | 72/159 |
| 880691 | 10/1961 | United Kingdom | 72/158 |

*Primary Examiner*—Ervin M. Combs
*Attorney, Agent, or Firm*—Michael J. Striker

[57] ABSTRACT

A tube bending machine comprises a bending table mounted on a support turnable about an axis and coaxially carrying an inner bending template surrounded by at least one outer bending template which is shiftable along said axis relative to the inner bending template so that a portion of the tube to be bent may be pressed by clamping means carried by the bending template against the outer surface of the inner or the outer bending template. The bending machine comprises further guide means including a releasable collet for guiding the tube toward the bending templates, the guide means being mounted on the support movable in longitudinal direction of the tube to be bent and in a direction transverse to the longitudinal direction.

8 Claims, 8 Drawing Figures

TUBE BENDING MACHINE

BACKGROUND OF THE INVENTION

The present invention relates to a tube bending machine with a bending table tiltable about an axis and which includes a bending template, clamping means movable toward and away from the bending template and an advancing carriage including a releasable clamping collet, which during the bending operation is movable toward the bending template.

During bending of tubes it is usually desired to make successive bends in the tube with the same bending radius to avoid during the bending of the tube a change of the bending templates. However, in many applications it is necessary to make successive bends with a different bending radius. For instance, during the bending of exhaust tubes for motor vehicles it is desirable to calculate the bending radius of the tube in order to obtain with the exhaust tube a predetermined pressure. This predetermined bending radius can, however, not be used for subsequent bending of the tube.

Tube bending machines are known in the art which comprise two superimposed fixedly arranged bending templates of different diameters. In using these known tube bending machines, the tube to be bent is first manually applied to the first bending template and, after bending, manually applied to the second bending template. This procedure is not only rather cumbersome but leads also to unexact results.

In order to bend tubes with different bending radii, one proceeded so far by bending a plurality of tubes with a first bending radius, by removing then the tubes from the bending machine and storing the same in the region of the machine, whereafter the used bending template has been removed from the bending machine and a new bending template with a different diameter has been placed thereon, whereafter the bent tubes are again placed into the machine to be provided with a subsequent bend having a different bending radius. This procedure is likewise not only cumbersome and time consuming but leads also to difficulties with respect to the exactness of the distances and angular positions of the successive bends with different bending radii. If the tube after a first bend or a plurality of first bends with the same bending radius is taken out of the machine, then it is difficult to place the tube bent in two or three different planes again into the bending machine. This requires to place the tube manually into the machine. A further difficulty arises to maintain the original position at which the tube has been held by the advancing carriage and the clamping collet connected thereto during the renewed placement of the tube into the clamping collet so that in the finished bent tube the distances between the bends of different bending radii and the angular position of the subsequent bends with different bending radii could not exactly be maintained. These difficulties also required additional adjusting operations on the finished tubes. Such subsequent adjusting operations are, however, not economical during serial production of tubes in which a great number of bent tubes have to be produced per time unit. From the above, it will be clear that bending of tubes with a plurality of subsequent bends of different bending radii has not been possible up to now with fully automatic, especially numerically controlled tube bending machines.

SUMMARY OF THE INVENTION

It is an object of the present invention to provide a tube bending machine which avoids the disadvantages of such tube bending machines known in the art.

It is a further object of the present invention to provide a tube bending machine, especially a fully automatic, numerically controlled tube bending machine with which tubes may be bent exactly with successive bends of different bending radii without change of the clamping in the tube advancing means.

With these and other objects in view, which will become apparent as the description proceeds, the tube bending machine according to the present invention mainly comprises support means, a bending table mounted on said support means tiltable about an axis, template means mounted on the bending table for tilting with the latter about said axis in which the template means comprise at least two coaxially arranged templates of different diameters movable relative to each other along said axis, clamping means on the bending table for clamping a portion of a tube to be bent against a respective one of the templates, guide means including releasable collet means for guiding a tube to be bent in longitudinal direction toward the template means, and means for moving the guide means in a direction transverse to the longitudinal direction.

With the bending machine according to the present invention it is, therefore, possible to provide in a tube successive bends with different bending radii without removing the tube intermediate the bends from the bending machine. Furthermore, during shifting of the templates relative to each other the tubes to be bent remain clamped in exactly predetermined positions so that the tubes may be bent with great exactness.

The present invention permits, therefore, to make successive bends with different bending radii in a numerically controlled tube bending machine in which the tubes may be exactly maintained in all positions during the bending so that resilient spring back of the tube may be considered and controlled by the bending program.

During the bending in numerically controlled tube bending machines, the tube remains always properly clamped. At first it is clamped in the clamping collet which is carried by the advancing carriage. When the clamping collet is opened for a short time, for instance, removed to another position, then the tube remains clamped during this time between a bending template and the clamping means so that the tube is properly held in the bending machine. This holds true also if the clamping collet is released in order to permit a return stroke of the advancing carriage so that the latter may again advance the tube, whereafter the tube is again clamped by the collet while a portion of the tube is pressed by the clamping means against the bending template which is subsequently turned to provide the desired bend in the tube.

The construction according to the present invention permits also a quick change of the bending templates since the bending templates of different diameters remain connected to the bending table and the bending templates are movable relative to each other in such a manner so that during bending of the tube about bending templates of different diameters the bending of the tubes occurs always at the same elevation relative to the bending table.

If a bending mandrel is used during the bending of the tubes, then a further feature according to the present invention includes a mandrel holder which is movable transverse to the advancing direction of the tube to be bent, whereby the mandrel holder is moved simultaneously and through the same distance in this transverse direction as the transverse movement of the advancing carriage.

According to a further feature of the present invention the outer bending template surrounds the inner bending template. Both templates are provided with peripheral grooves which in this case are arranged in a plane normal to the axis along which the templates are movable.

Preferably the inner bending template is arranged about a shaft, which is mounted in a turntable provided in the bending table, and movable in axial direction and the inner bending template is surrounded by an outer bending template which is liftable by the shaft above the inner template.

The outer template has preferably a top wall extending transversely over the inner template and the aforementioned shaft has adjacent one end thereof a shoulder abutting against the top wall of the outer template so that the latter may be lifted above the inner template during upward movement of the shaft. With a similar construction it is in a simple manner also possible to use three or even more bending templates of different bending radii which may be used in quick succession to each other, whereby for instance the first bend is carried out with the bending template of the smallest bending radius, whereafter a subsequent bend may be carried out with the largest bending template and a next-following bend may be carried out again with the smaller bending template. The bending templates of different bending diameters remain mounted on the bending table and by axial movement of the templates relative to each other it is possible to bring each time the desired bending template into action, whereas the non-used bending template is lifted above the respective used one. In order to obtain this it has been found especially advantageous that the lifting shaft, if three bending templates are used, is constructed as a stepped shaft providing two shoulders of different outside diameters which are spaced in axial direction from each other a distance equal to the inner height of the templates to be lifted. If only two bending templates are used, then the stepped shaft has only a single shoulder. By coaxial arrangement of for instance four bending templates which are telescopically arranged within each other, the stepped shaft has to be provided with three shoulders. The number of shoulders provided on the shaft is, therefore, smaller by one than the number of bending templates.

The apparatus includes further means for moving the lifting shaft in axial direction and such moving means preferably comprise a cylinder mounted on the bending table, a piston connected to the other end of the lifting shaft and slidably guided in the cylinder and means for feeding pressure fluid into and out from the cylinder to opposite sides of the piston. In this way it is possible to quickly lift the non-used bending template hydraulically or pneumatically above the bending template to be used.

According to a further feature of the present invention, the drive shaft for turning the bending table is hollow and coaxially surrounds the lifting shaft serving to shift one or more of the bending templates provided.

The cylinder in which the piston of the lifting shaft is slidably arranged is preferably connected to the cylindrical extension of a turntable coaxial with the lifting shaft on which the bending templates are mounted.

In order to bring the bending template into an exact angular position with respect to the bending table, it is also suggested that the aforementioned cylinder is provided with a coaxial outer chain gear cooperating with a chain drive by means of which the turntable and the bending template thereon may be turned. An appropriate scanning device may cooperate with the chain drive to establish the angular position of the bending templates.

In order to reduce the action of the forces occurring during the bending of the tubes onto the bending templates it is also suggested according to the present invention to maintain the outer surface of the inner bending template in contact with the inner surface of the surrounding outer bending template. This will also assure an exact centralizing of the telescopically arranged templates.

The templates are connected to the turntable for turning movement therewith by a key extending transverse to the axis of the turntable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
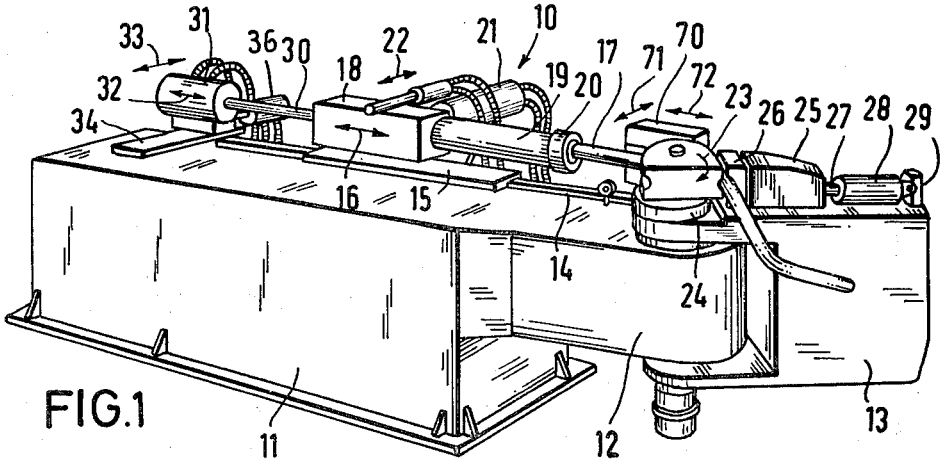
FIG. 1 is a perspective view of the tube bending machine according to the present invention.

Referring now to the drawing and more specifically to FIG. 1 of the same, it will be seen that the tube bending machine 10 according to the present invention comprises a support or housing 11 constructed from steel sheets welded together and provided at its front end with a projecting extension 12 which carries a bending table 13 tiltable about a vertical axis. A rail 14 extending in the longitudinal direction of the support 11 and the extension 12 thereof is mounted on the upper surface of the aforementioned members on which a slide 15 is movable in direction of the double-headed arrow 16 toward and away from the bending table 13. The slide 15 carries a housing 18 which in turn carries a cylinder 19 provided at its free end with a clamping collet 20 for clamping a tube 17 to be bent in the machine. The elements 15, 18 and 19 constitute guide means or a feed carriage for guiding a tube 17 to be bent toward the bending table. The aforementioned guide means are provided with a laterally projecting hydraulic cylinder 21 cooperating with the cylinder 19 for moving the same in direction of the double-headed arrow 22 transverse to the elongation of the rail 14 for a purpose as will be described later on. The portion of the tube 17 projecting beyond the clamping collet 20 is brought into engagement with the peripheral surface of a template 23 mounted on the upper surface of a turntable 24 coaxially arranged with the tilting axis of the bending table 13 and movable with the latter. The tube 17 is pressed onto the peripheral surface of the bending template 23 by a chuck 25 having a clamping jaw 26 and the chuck with its clamping jaw is operated by the piston rod 27 of an operating cylinder 28 connected at its right end, as viewed in FIG. 1, to an abutment 29 projecting upwardly from the bending table 13. A block 70 is arranged on the extension 12 laterally of the bending template 23 movable in direction of the double-headed arrows 71 and 72 by conventional means not shown in the drawing relative to the bending template 23 to prevent buckling of the tube 17 away from the bending template during bending of the tube. If a mandrel is used during bending of the tube 17, which is advisable during bending of the tube along a small bending radius, then the mandrel rod 30 is connected at its outer end projecting towards the left, as viewed in FIG. 1, beyond the housing 18 to cylinder-and-piston means 32 for moving the mandrel rod 30 in the direction of the double-headed arrow 32. The cylinder 31 is mounted on a slide 34 and movable in a direction as indicated by the double-headed arrow 33 by a hydraulic cylinder 36 mounted on the support 11 and having a piston rod 35 (FIG. 2) engaging the cylinder 31.

Figure 2:
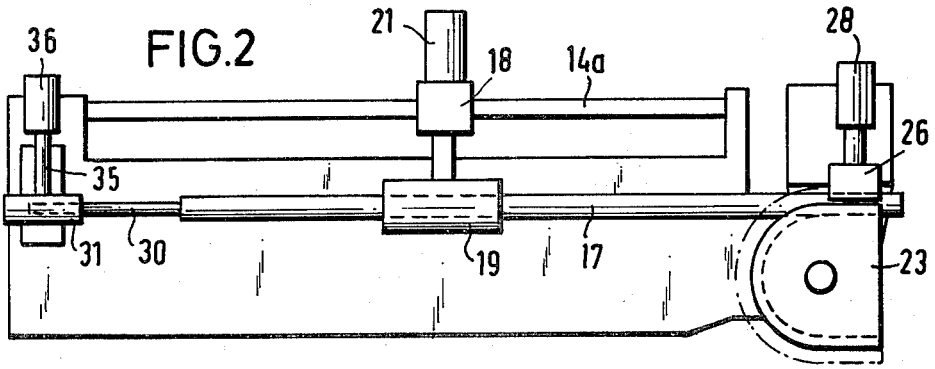
FIG. 2 is a schematic top view of a slightly modified bending machine.

FIG. 2 shows a slight modification of the abovedescribed arrangement in which the rail 14 is not mounted on the upper surface of the support 11 but laterally therefrom in form of a cylindrical rod 14*a*. The housing 18 in this construction is movable in the longitudinal direction of the rod 14*a* and the piston rod of the cylinder 21 carried by the housing 18 is connected to the cylinder 19 carrying the tube 7 to be bent. The clamping device 28 and 26 in this construction is arranged in a starting position substantially normal to the elongation of the unbent tube 17 and the block 70 may, therefore, be omitted in this modified arrangement.

Figure 4:
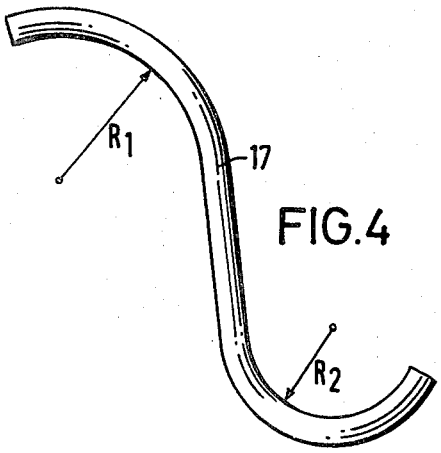
FIG. 4 is a view of a bent tube with two different bending radii.

After having thus described the basic construction of the tube bending machine, reference is now had to FIG. 4 showing a tube 17 provided with two successive bends along different bending radii $R_1$ and $R_2$.

Figures 5, 6:
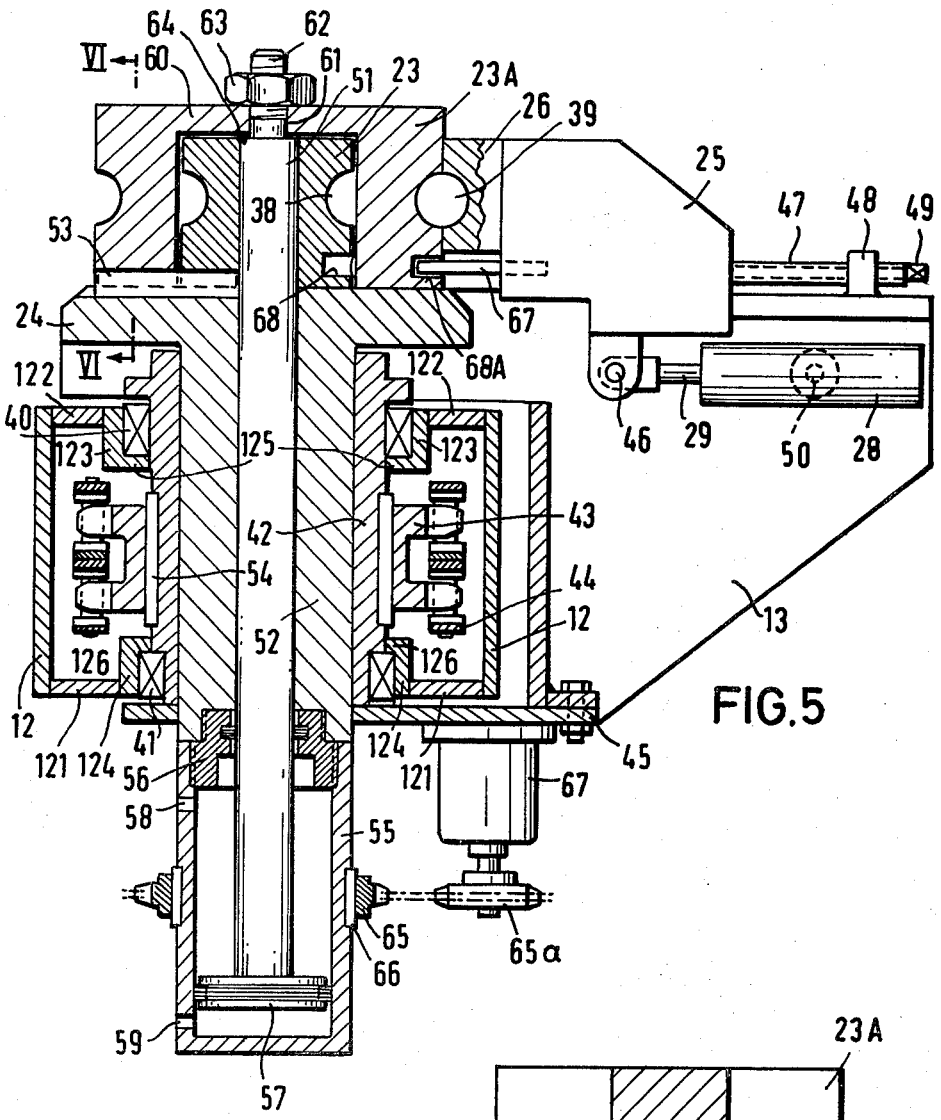
FIG. 5 is a partial section through the bending table.
FIG. 6 is a cross-sectional taken along the line VI—VI of FIG. 5.

In order to bend a tube in the manner as shown in FIG. 4 without removing the tube from the bending machine, the latter is provided, as shown in FIG. 5, with two bending templates 23 and 23A mounted on the turntable 24 of the machine, whereby the outer bending template 23A surrounds the inner template 23. The two templates 23 and 23A are provided at the peripheral surface thereof respectively with semicircular peripheral grooves 38 and 39, the centers of which are arranged in a common plane, that is the centers of the two grooves have the same distance from the upper surface of the turntable 24.

The extension 12 of the support or machine housing is composed of steel plates or steel sheets welded together which are referred to in the cross-section of FIG. 5 with the reference numerals 12, 121, 122, 123, 124, 125 and 126. This box-shaped hollow housing 12 carries two coaxial bearings 40 and 41 in which the main drive shaft 42 is turnably mounted. The hollow drive shaft 42 is rotated by means of a chain gear 43 connected thereto by key 54 and engaged by chain 44, which in turn is driven by a motor, not shown in the drawing. The hollow drive shaft 42 is fixedly connected at its lower end, for instance by welding, to a bottom plate 45 connected to the bending table 13. The bending table 13 carries as mentioned in the description of FIG. 1, the chuck 25 with the clamping jaw 26. The arrangement of the chuck 25 shown in FIG. 5 is slightly different from that shown in FIG. 1. In the construction shown in FIG. 5 the operating cylinder 28 with the piston rod 29, which is connected by a bolt 46 to the chuck 25 is arranged laterally on the bending table 13. In addition a screw spindle 47 turnably mounted in a lug 48 projecting upwardly from the bending table 13 is provided, in which the spindle can be turned by means not shown in the drawing connected to the square free end 49 of the spindle 47. The operating cylinder 28 is tiltably mounted by means of a bolt 50 on the bending table 13.

A lifting shaft 51 extends coaxially through a bore in the inner template 23 and the lifting shaft 51 is mounted for movement in axial direction in a central bore of the turntable 24 which extends also through a cylindrical extension 52 of the turntable. The bending templates 23 and 23A are provided at the bottom faces thereof with a radially extending groove in which a key 53 is inserted, which in turn is also mounted in a corresponding radial groove on the upper surface of the turntable 24. In this way the bending templates 23 and 23A are connected to the turntable 24 for turning movement therewith.

When the main drive shaft 42 is turned by the chain drive connected thereto, the bending table 13 connected in the aforementioned described manner to the main drive shaft 42 is also turned with the latter. During bending of a tube, a portion of the latter is pressed by the chuck 25 and the clamping jaw 26 thereof by means of the piston rod 29 of the operating cylinder 28 against the peripheral surface of the bending template 23 or 23A, and a pin 67 projecting from the chuck 25 engages into a corresponding bore 68A of the bending template 23A so that the latter is turned together with the bending table. If the outer template 23A is lifted in the manner as will be described later on beyond the inner template 23, the chuck 25 is shifted laterally so that the pin 67 will engage in a corresponding bore 68 of the inner template 23. In this way the respective template is turned about the axis of the shaft 51 during tilting of the bending table about this axis.

A cylinder 55 is connected by means of a stepped connecting ring 56 provided at its outer peripheral surface with screw threads to the lower end of the cylindrical extension 52 of the turntable 24. Appropriate locking means, not shown in the drawing, are provided for preventing unscrewing of the connecting ring. The lifting shaft 51 extends into the cylinder 55 and carries at its lower end a piston 57 slidably guided in the cylinder. Bores 58 and 59 in the region of opposite ends of the cylinder 55 serve for connecting conduits thereto for feeding pressure fluid into and out from the cylinder to opposite sides of the piston 57 so that the lifting shaft 51 may be raised or lowered as desired.

The outer bending template 23A has a top wall 60 extending over the upper surface of the inner template 23 and the top wall 60 is provided with a central bore through which a reduced diameter portion 62 of the lifting shaft 51 extends. The reduced diameter portion 62 is provided with an outer screw thread onto which a nut 63 is screwed engaging the upper surface of the top wall 60 of the outer template 23A. A shoulder 64 at the junction of the reduced diameter portion 62 and the remainder of the lifting shaft 51 engages the bottom surface of the top wall 60 of the outer template so that the latter is constrained to follow the axial movement of the lifting shaft 51.

An annular chain gear 65 surrounds the cylinder 55 and is connected thereto for turning movement therewith by a key 66. The gear 65 is driven by a chain drive including another chain gear 65*a* driven by a hydraulic motor 67 connected to the bottom plate 45 of the bending table 13, so that the cylinder 55, the turntable 24 connected thereto and the templates 23 and 23A may be turned to a starting position before the next bend of a tube is carried out.

The above-described arrangement will be operated as follows:

Assuming the first bend of the tube 17 is carried out about the outer template 23A then the various elements of the turntable are arranged in the manner as shown in FIG. 5 by means of which a tube portion is clamped by the clamping means 25, 26 against the outer periphery of the outer template 23A and the bending table 13 is then turned by operating the chain drive 43, 44. Since the pin 67 is engaged in this position in the bore 68A of the outer template 23A, the outer template 23A is turned together with the bending table 13 and so is the turntable 24 and the inner template 23 since both templates are connected to the turntable by the key 53. Subsequently thereto, the clamping means 25 and 26 are opened so that the pin 67 is withdrawn from the bore 68A and the bending table 13 is moved back by the chain drive 43, 44 to its starting position. The tube 17, is properly held during opening of the clamping means by the clamping collet 20. Subsequently thereto the cylinder 19 carrying the clamping collet 20 is moved by the cylinder-and-piston arrangement 21 toward the right, as viewed in FIG. 5, to remove the tube out of the groove 39 of the outer template 23A. Subsequently thereto pressure fluid is fed through the opening 59 in the cylinder 55 below the piston 57 on the lifting shaft 51 so that the latter is raised to lift the outer template 23A above the inner template 23. The inner template 23 is then moved to its starting position by operating the hydraulic motor 67 which in turn drives over the chain drive 65*a*, 65, the cylinder 55 and the turntable 24 connected thereto and therewith also the inner template 23 connected by the key 53 to the turntable. The tube is then shifted in axial direction by advancing the guide means 15, 18 and 19 in the direction toward the template. Subsequently thereto, the tube 19 with the clamping collet 20 is shifted by the cylinder-and-piston arrangement 21 so that the tube will engage in the groove 38 of the inner template 23 and then the clamping means 25, 26 are moved towards the left, as viewed in FIG. 5, to clamp the tube portion against the inner template 23 and simultaneously the free end of the pin 67 is moved into the bore 68 of the inner template. The bending table 13 is then again turned about the axis of the shaft 51 by operating the chain drive 43, 44 to make the second bend in the tube. It is to be understood that if a mandrel is used during the bending operation, the mandrel rod 30 has to be moved in longitudinal and transverse direction by the cylinder-and-piston arrangements 31 and 36 together with the corresponding movement of the cylinder 19 carrying the clamping collet in longitudinal and transverse directions. The same holds true with the block 70 shown in FIG. 1.

Figure 7:
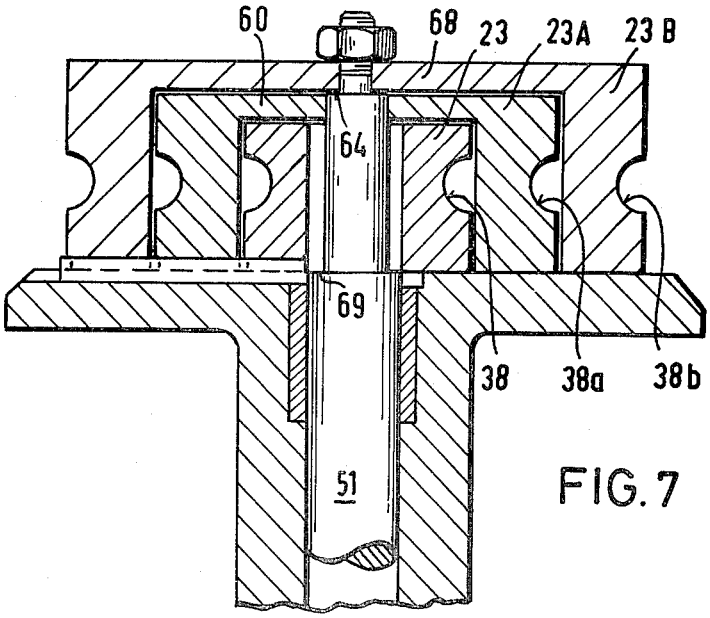
FIG. 7 is a vertical cross-section through the upper part of the bending table with three bending templates arranged one in the other.

FIG. 7 illustrates in cross-section an arrangement in which three bending templates 23, 23A and 23B are used which are arranged one in the other. The two outer templates 23A and 23B have top walls 60, respectively 68. The lifting shaft 51 is a stepped shaft provided with two axially spaced shoulders 64 and 69, respectively adapted to engage the bottom surfaces of the top walls 68 and 60. The shoulders 64 and 69 are spaced in axial direction from each other a distance substantially equal to the inner height of the outermost template 23B.

Figure 8:
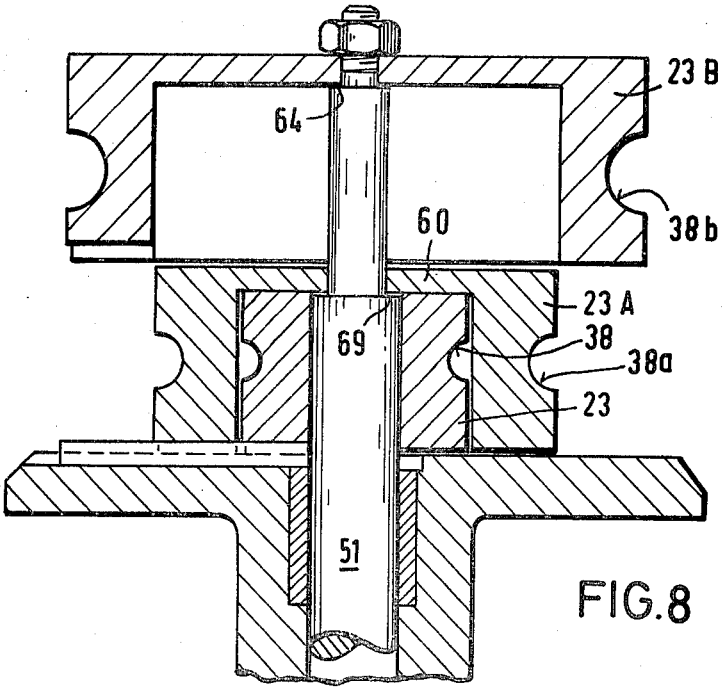
FIG. 8 is a view similar to FIG. 7 with the outermost template lifted.

FIG. 8 illustrates an outermost template 23B lifted by the lifting shaft 51 to an unoperative position. If the lifting shaft 51 is further raised the middle template 23A may also be lifted by engagement of the shoulder 69 with the bottom surface of the top wall 60 to thereby move the middle template 23A likewise to its inoperative position. As evident from FIGS. 7 and 8 a quick lifting and lowering of the templates 23A and 23B is assured by hydraulically or pneumatically operating the shaft 51.

Figure 3:
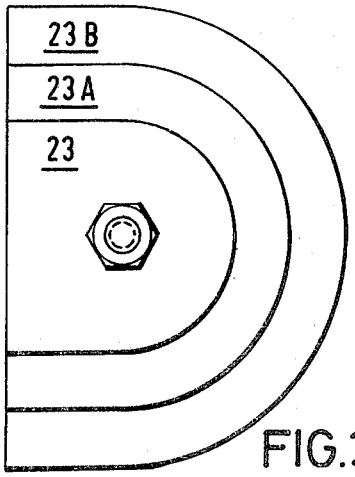
FIG. 3 is a top view of a plurality of templates fitted one into the other.

FIG. 3 schematically illustrates a top view of the three bending templates whereby for simplification of the drawing the top walls 60 and 68 are omitted in FIG. 3.

It is to be understood that the varying fluid-operated cylinders and hydraulic drive motors of the tube bending machine according to the present invention may be automatically controlled in a manner known per se by punched tapes or computers.

FIG. 8 shows also, differing from FIG. 7, that the three templates are provided with grooves of different cross-section. Thus the innermost template 23 has a semicircular groove 38 for a small tube diameter, whereas the intermediate template 23A has a groove 38*a* of the same size as in FIG. 7, and the outermost template 23B has a groove 38*b* for a larger tube diameter. In this way it is possible to adopt the bending machine according to the present invention quickly for bending tubes of different outer diameters. It is mentioned that it happens often that tubes of larger diameter are pushed over tubes of smaller diameter or that such tubes of different diameters are connected by a socket joint. With the machine of the present invention it is, therefore, possible also to bend tubes of different diameters.

It will be understood that each of the elements described above, or two or more together, may also find a useful application in other types of tube bending machines differing from the types described above.

While the invention has been illustrated and described as embodied in a tube bending machine having bending templates of different diameter which can be respectively placed in operating position by shifting the same in axial direction relative to each other, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

I claim:

1. A tube bending machine comprising elongated support means; a bending table mounted on said support means tiltable about an axis; template means mounted on said bending table for tilting with the latter about said axis, said template means comprising at least two coaxially arranged templates of different diameters movable relative to each other along said axis, one of said templates being an inner bending template and the other being an outer bending template at least partly surrounding said inner bending template; means for shifting said outer bending template in axial direction relative to said inner bending template, said shifting means comprising a lifting shaft extending along said axis through said inner template and being movable in direction of said axis for lifting said outer template above said inner template; clamping means on said bending table for clamping a portion of a tube to be bent against the respective template; guide means including releasable collet means for guiding a tube to be bent in longitudinal direction towards said template means; and means for moving said guide means in a direction transverse to said longitudinal direction.

2. A tube bending machine as defined in claim 1, wherein said outer template has a top wall extending transversely over said inner template, said lifting shaft having adjacent one end thereof a shoulder abutting against said top wall.

3. A tube bending machine as defined in claim 2, and including means for moving said lifting shaft in axial direction, said moving comprising a cylinder mounted on said bending table, a piston connected to the other end of said lifting shaft and slidably guided in said cylinder, and means for feeding pressure fluid into and out from said cylinder to opposite sides of said piston.

4. A tube bending machine as defined in claim 3, and including means for turning said bending table about said axis, said turning means comprising a hollow drive shaft coaxially surrounding said lifting shaft and means for turning drive shaft about its axis.

5. A tube bending machine as defined in claim 4, and including a turntable coaxial with and turnable about said axis of said bending table, said template means being mounted on said turntable, said turntable having a coaxial cylindrical extension having a free end opposite said template means, said lifting shaft extending through said turntable and said extension and said cylinder being connected to the free end of said cylindrical extension for turning therewith about said axis.

6. A tube bending machine as defined in claim 5, wherein each of said templates has an inner and outer arcuate surface and wherein the inner surface of each template engages, when the templates are located one in the other, the outer surface of the template it surrounds, and including a key groove at the end of each template facing said turn table and a key in said key groove for connecting said templates to said turn table for turning therewith.

7. A tube bending machine as defined in claim 1, wherein said template means comprises three coaxially arranged templates of different diameter arranged one within the other and lifting means for lifting the outer two of the three templates relative to each other and relative to the innermost of said three templates.

8. A tube bending machine as defined in claim 7, wherein each of the two outer templates has a top wall extending transverse to said axis and wherein said lifting means comprises a stepped lifting shaft extending along said axis through said innermost template and through openings in the top walls of the two other templates, said stepped shaft having two shoulders spaced from each other a distance at least equal to the inner height of the outermost template and adapted to abut respectively against the top walls of the respective templates during axial movement of said lifting shaft.

* * * * *